US006966788B1

(12) United States Patent
Ruhl, Jr.

(10) Patent No.: US 6,966,788 B1
(45) Date of Patent: Nov. 22, 2005

(54) ANTI-DECOUPLING MECHANISM FOR SOLID OR TUBULAR CIRCULAR CROSS SECTION ASSEMBLIES HAVING A ROTATING COUPLING NUT OR NUTS

(76) Inventor: Harold John Ruhl, Jr., 95 Dunn Hill Rd., Durham, CT (US) 06422

( * ) Notice: Subject to any disclaimer, the term of this patent is extended or adjusted under 35 U.S.C. 154(b) by 0 days.

(21) Appl. No.: 10/906,993

(22) Filed: Mar. 15, 2005

(51) Int. Cl.[7] ..... H01R 13/62
(52) U.S. Cl. ..... 439/312; 439/276
(58) Field of Search ..... 439/312, 321, 439/313–320, 322, 323, 276, 521, 587

(56) References Cited

U.S. PATENT DOCUMENTS

| | | | | |
|---|---|---|---|---|
| 4,676,574 A | * | 6/1987 | Grosso et al. | 439/271 |
| 5,199,894 A | | 4/1993 | Kalny | |
| 5,653,605 A | * | 8/1997 | Woehl et al. | 439/321 |
| 6,086,400 A | * | 7/2000 | Fowler | 439/321 |
| 6,123,563 A | | 9/2000 | Johnson | |
| 6,152,753 A | * | 11/2000 | Johnson et al. | 439/321 |
| 6,375,509 B2 | * | 4/2002 | Mountford | 439/610 |

* cited by examiner

*Primary Examiner*—Gary Paumen
*Assistant Examiner*—James R. Harvey

(57) ABSTRACT

Disclosed is an anti-decoupling mechanism for maintaining the assembly of sets of tubular components using rotating coupling nuts such as circular electrical connectors. To accomplish this, a multiplicity of detent slots (teeth) engage a multiplicity of flexible detent tooth engaging members—from one such member in the mechanism up to one for each tooth in the mechanism. The geometry, multiplicity, and spacing of the detent components allows on the order of 47 or more locked positions on a tooth ring 0.6 inches in average diameter at the teeth. Adding a second set of teeth utilizing a second direction of flex of the flexible detent tooth engaging members (circumferential) can double this amount. By compound sloping of the detent teeth the mechanism takes advantage of the natural axial motion of the coupling nut to increase but limit the force on the flexible detent tooth engaging members as the components are progressively mated and thereby beneficially altering the torque required to rotate the coupling nut. The direction of flex of the flexible detent tooth engaging members also increases the forces tending to retain the coupling nut in proper position under vibration. The device also includes a full set of especially configured rotating/sliding or fixed joint seals to enclose the critical anti-decoupling components of the mechanism in a sealed environment, but nevertheless relieving air pressure changes that take place within the mechanism so as to reduce seal wear.

10 Claims, 6 Drawing Sheets

SECTION A-A
(LESS ITEMS 5 & 6)

SECTION B-B
(LESS ITEMS 5 & 6)

ANTI-DECOUPLING MECHANISM FOR SOLID OR TUBULAR CIRCULAR CROSS SECTION ASSEMBLIES HAVING A ROTATING COUPLING NUT OR NUTS

BACKGROUND OF THE INVENTION

1. Field of the Invention

The present invention generally relates to anti-decoupling mechanisms for solid or tubular circular cross section assemblies of the type in which the coupling together of two sub assemblies into a full assembly is achieved by means of a threaded or bayonet style or other rotating motion engagement coupling nut. This coupling nut is either permanently attached to or installed on one of the sub assemblies at the time of assembly of the sub assemblies into a full assembly in a manner that restricts its extent of motion along the axis of that subassembly in at least the direction towards the other subassembly. For the threaded version, the coupling nut threads engage mating threads on the second sub assembly by means of the rotation and this engagement is the primary means of maintaining the integrity of the complete assembly. Once the two sub assemblies have been properly assembled into a full assembly it is generally imperative that the coupling nut should be prevented from rotating to the degree desired by some means. Therefore, more particularly, the present invention relates to anti-decoupling devices that use a set of detent teeth combined with a set of spring loaded or self springing (or both) flexible detent tooth engaging members to create a mechanism to differentially limit the rotational freedom of the coupling nut. These differential limits are established so as to ease the coupling together of the two sub assemblies, properly maintain the coupling once it is accomplished, and allow repeated assembly and disassembly.

2. Description of the Related Art

A typical assembly to which the present invention may be applied includes a tubular cross section connector shell containing electrical contacts and an internally threaded coupling nut rotatably mounted on the connector shell. The connector shell is coupled to a corresponding externally threaded tubular cross section mating connector by means of the coupling nut in such a manner that electrical contacts in the mating connector engage the electrical contacts in the connector shell. The coupling nut is held on the connector shell by one of a variety of methods. Because the frictional anti-locking force generated by engagement between the coupling nut and connector shell threads in such an arrangement is insufficient to prevent the coupling nut from rotating in a decoupling direction as a result of various forces present in the application environment, it is conventional to include an additional anti-decoupling mechanism. For a reference to one such electrical connector assembly see the circular electrical connectors described by Mil-DTL-38999, (/26, "Series III") which is incorporated herein by this reference.

One such anti-decoupling mechanism is disclosed in U.S. Pat. No. 5,199,894. This mechanism works well but has several disadvantages:

(1) It contains a substantial multiplicity of differently configured complex and precision parts (2) The resilient rings disclosed are not necessarily optimal for inclusion in rotating/sliding joints and the ring materials may disintegrate due to this rotation/sliding combined with the effects of environmental contaminants and conditions such as engine fuels, hydraulic fluids, high or low ambient temperatures, temperature increases of the assembly due to the dissipation of vibrational energy in the assembly or structures to which it is secured, and other similar factors. The pieces of these rings can then jam the mechanism. This wear on the seals can be aggravated by distortions of the seals due to air pressure changes within the anti-decoupling mechanism due to volumetric and temperature changes as the mechanism couples and decouples and when the mated connectors are in service.

(3) Inherent in the mechanism is a vulnerability to a reduction in the coupling and decoupling torques by contamination that gets between the two facing plates of intermeshing detent teeth or damage to the detent teeth themselves. If one detent tooth is prevented from fully engaging this will separate the two plates and reduce the degree of engagement of a multiplicity of detent teeth on either side of the blocked tooth.

The present invention, on the other hand, offers various improvements to the decoupling mechanism described in U.S. Pat. No. 5,199,894 including but not limited to: lower complexity, three especially configured seals, and a contamination tolerant, self cleaning detent tooth/flexible detent tooth engaging members configuration. There are numerous other anti-decoupling mechanisms in use such as that disclosed in U.S. Pat. No. 6,123,563 but since there is always a growing multiplicity of complex and severe service applications for assemblies such as mated circular electrical connectors such as space born applications such new applications perhaps stimulating previously unknown failure modes there is always a corresponding need for the kinds of improvements disclosed herein.

SUMMARY OF THE INVENTION

Accordingly it is a first objective of the present invention to provide a low coupling torque, high decoupling torque anti-decoupling mechanism that utilizes a small number of parts and a small number of different parts.

It is a second objective of the present invention to provide such an anti-decoupling mechanism in which the coupling and decoupling torques can be adjusted easily in a repeatable and reliable fashion with minimal manufacturing effort and component interchange.

It is a third objective of the present invention to provide an anti-decoupling mechanism which can be easily assembled, and for which the parts of the assembly are generally simple to manufacture.

It is a fourth objective of the present invention to reduce the angle of rotation of the coupling nut that takes place between high decoupling torque positions in such an anti-decoupling mechanism to less than one primary detent tooth pitch of the primary teeth by configuring and positioning additional engaging components such as additional sets of detent teeth in a way that minimizes negative effects on available locked torque and also minimizes wear of the mechanism and increases the use of the flexible detent tooth engaging members.

It is a fifth objective of the present invention to provide easily manufactured and installed high temperature, pressure change accommodating environmentally resistant seals for the anti-decoupling mechanism at all interfaces that need to be sealed.

It is a sixth objective of the present invention to reduce some causes of vibrational loosening of such assemblies not usually considered.

It is a seventh objective of the present invention to provide a simple utilization of the consequent axial motion of the coupling nut that takes place regardless of the way in which the coupling nut is attached to the shell. During and at the end of any mating process of the type described, the axial forces on the threads of the coupling nut increase to some degree as they progressively engage their mating threads and especially so if the coupling nut is further rotated in the coupling direction after the two connector assemblies otherwise come to rest with respect to each other as is the case in any assembly tightly joined by bolting. This increase in axial force causes the coupling nut to move towards the mating assembly to some degree in all such assemblies due to the stress on the associated component that progressively loads energy into the components by means of their progressive strain and so limits the motion of the coupling nut in this direction. The objective is to use this motion in a simple way to enhance the torque characteristics and mating integrity maintenance performance of the anti-decoupling mechanism.

It is an eighth objective of the present invention to achieve a small size for the mechanism so it will easily fit the envelope constraints of the most demanding set of requirements.

It is a ninth objective of the present invention to provide a contamination tolerant self cleaning detent mechanism.

It is a tenth objective of the present invention to minimize wear of the mechanism by making provision for the use of a large number of flexible detent tooth engaging members so as to distribute the necessary contact forces over a large area.

It is an eleventh objective of the present invention to provide independent or semi independent motion of the flexible detent tooth engaging members while nevertheless reinforcing them in a way that does not require them to provide all of the necessary spring force themselves. This allows these members to be made from wear resistant materials that are not necessarily also optimized for spring function.

It is a twelfth objective of this invention to provide an easily inspected and serviceable mechanism for some applications.

These objectives of the invention are achieved, according to the principles of a preferred embodiment of the invention, by providing the anti-decoupling mechanism described as follows:

BRIEF DESCRIPTION OF THE DRAWINGS

The drawings are.

(1)

(2)

(3)

(4)

(5)

(6)

(7)

DETAILED DESCRIPTION OF THE PREFERRED EMBODYMENTS

Figure 1:
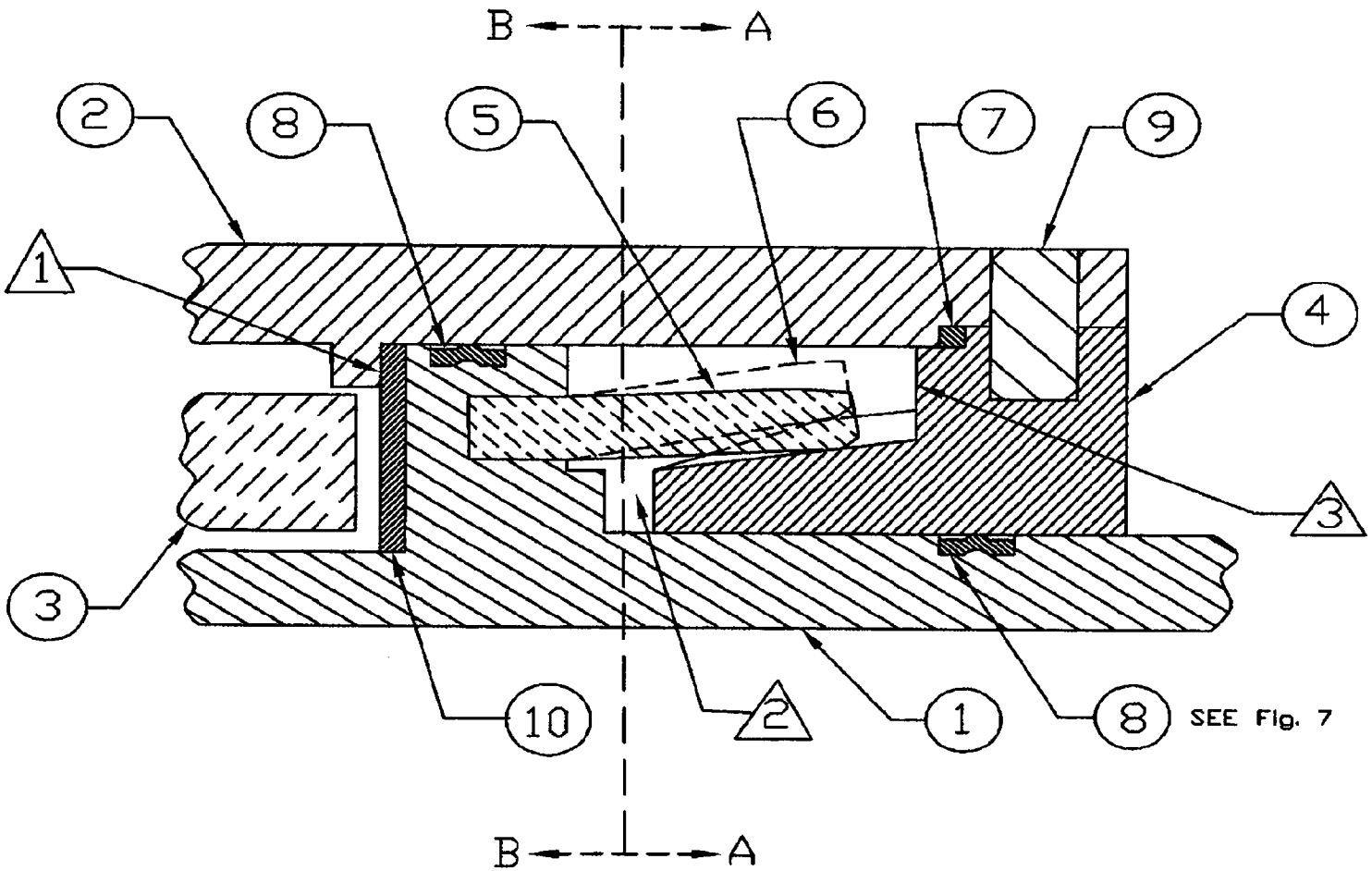
FIG. 1: A cross section of a preferred configuration of the disclosed anti-decoupling mechanism taken at one location on the circumference of a tubular cross section shell, the mechanism actually extends around the entire circumference of the shell. The section is also showing a limited amount of the axial extent of the shell 1, the coupling nut 2, and a limited amount of the axial extent of the mating assembly 3 which is shown just before it finishes moving to the right and contacting the shell during the mating process.

As illustrated in FIG. 1, which shows a cross section of the anti-decoupling device at one location on the circumference of a tubular assembly and the tubular assembly in the immediate vicinity of the device said device actually extending around the complete circumference of the tubular assembly, an anti-decoupling device constructed in accordance with the principles of a preferred embodiment of the invention includes:

A tubular shell 1 with an external radially extended flange.

A tubular coupling nut 2 with internal radially extended flange.

Figure 2:
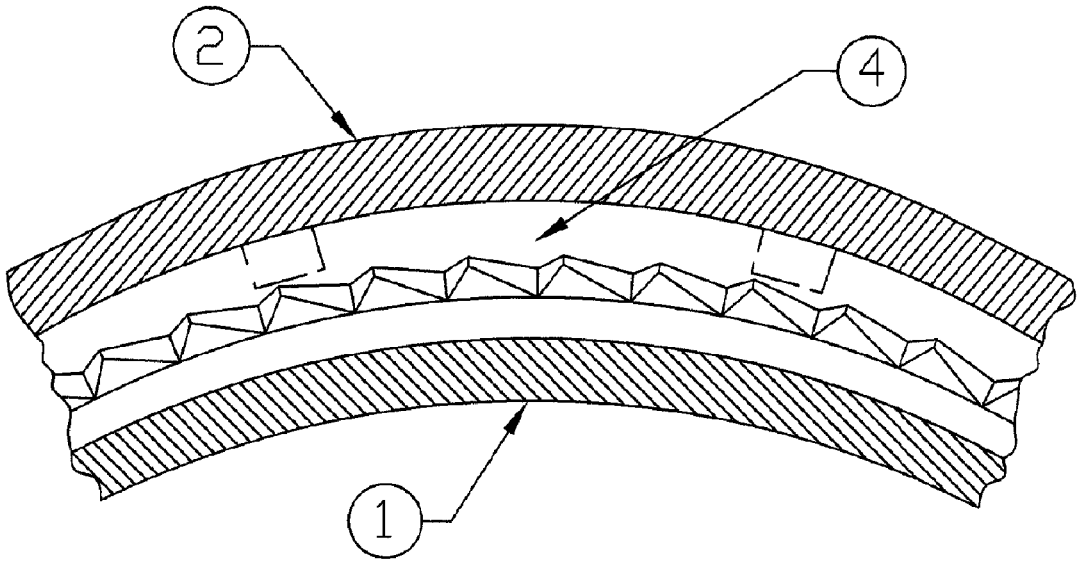
FIG. 2: A section from FIG. 1, absent the flexible detent tooth engaging members, showing the detent teeth on ring 4. (Section A—A in FIG. 1).

A ring 4 with built in or attached detent slots (teeth) which is fixed to the coupling nut by various and perhaps multiple but ordinary means at 9 (A dowel pin method of fixing the ring 4 to the coupling nut 2 is shown, but other common methods could be used such as a keyed snap in arrangement or a screw in arrangement, etc). Section A—A which is given in FIG. 2 as a portion of the ring 4 shows the compound sloped detent teeth of Ring 4 less the flexible detent tooth engaging members. In this case an external truncated conical surface arrangement with the apex of the cone pointed toward the flexible detent tooth engaging members and toward the mating assembly is shown but an external cylindrical surface arrangement (parallel to the axis of the shell 1 is also possible, however not all features of the mechanism are available with a cylindrical tooth arrangement. This section also shows how dowel pins 9 (one of a multiplicity of assembly methods) can be spaced about the circumference of the ring 4 to fix it to the coupling nut 2 in a stable and reliable fashion. This section also shows that the detent teeth can be asymmetric in form as is needed to meet the desired differential torque requirements for the anti-decoupling mechanism.

Figure 3:
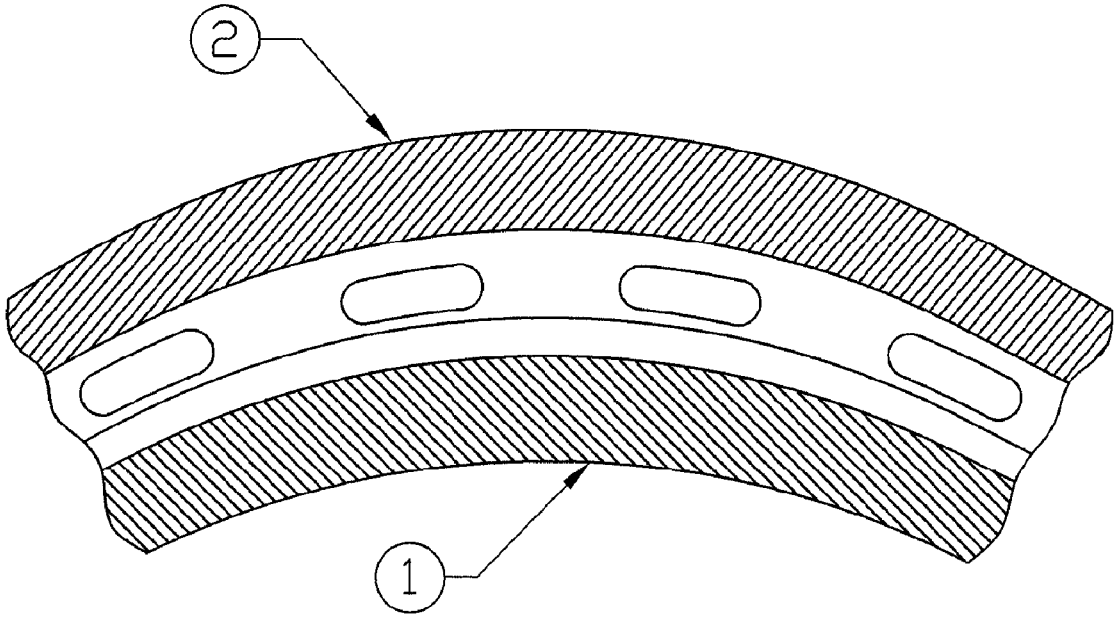
FIG. 3: A section from FIG. 1, absent the flexible detent tooth engaging members, showing a slot based method for securing the flexible detent tooth engaging members to the shell 1. (Section B—B in FIG. 1)

A multiplicity of flexible detent tooth engaging members 5 and 6 fixed into the radially extended flange of the shell 1 by ordinary means. Two such members are illustrated in the Figure—the sectioned one 5 illustrating the locked position and the second one 6 (shown dashed behind 5) illustrating the unlocked position, but there can be anywhere from one flexible detent tooth engaging member in the mechanism up to one for each tooth on the ring 4. The flexible detent tooth engaging members secured to the shell 1 by being inserted into and held in a hole or slot in the shell's 1 radially extended flange by press fit, brazing, welding, etc. is shown and a flexible detent tooth engaging member—item 6—is shown dashed in the background of FIG. 1 to illustrate how the flexible detent tooth engaging members must flex as the detent teeth of ring 4 are moving past them due to the rotation of the coupling nut 2 to which the ring 4 is solidly fixed. The Section B—B which is given in FIG. 3 shows the face of a portion of the radially extended flange of shell 1 less the flexible detent tooth engaging members that would be secured to it. In this case slots are shown for securing the flexible detent tooth engaging members to the flange by pressing, soldering, brazing, or welding (as stated above) the tabs of the part shown in FIG. 4 (also see the next paragraph) into the slots as one set of examples of the multiplicity of possible methods for securing the flexible detent tooth engaging members to the shell 1.

Figure 4:
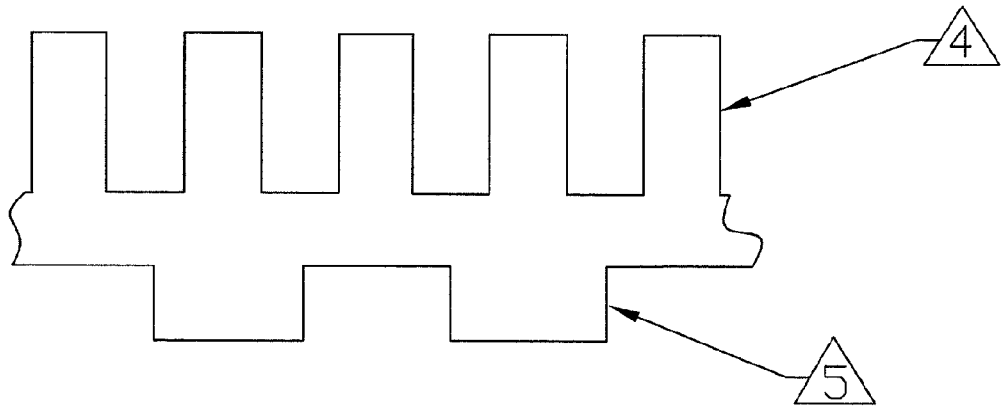
FIG. 4: A view of a possible fabrication of the flexible detent tooth engaging members as one integrated piece to ease assembly of the mechanism. This integral piece includes a series of tabs to retain it in position on shell 1 using the slots shown in FIG. 3.

See FIG. 4 for a possible assembly of the flexible detent tooth engaging members —Note Flag 4 of FIG. 4—as an integral single piece formed from flat stock or otherwise made flat and having tabs —Note Flag 5 of FIG. 4—to fit in the slots shown in FIG. 3 when this flat piece is wrapped about the shell 1 and secured to it. As described above this is just one of a multiplicity of possible methods for securing the flexible detent tooth engaging members to the shell 1 and represents a compromise between the degree of independent motion of the members and simplicity of manufacture and assembly of the mechanism. Note that the scale of the features in FIGS. 1, 2, 3, 4, 5, 6, and 7 are not coordinated across the Figures.

A shoulder on the ring 4 is positioned to prevent the flexible detent tooth engaging members from coming out of holes or slots in the shell and afterwards acting as foreign bodies in the mechanism. See Note Flag 3 in FIG. 1.

Figure 5:
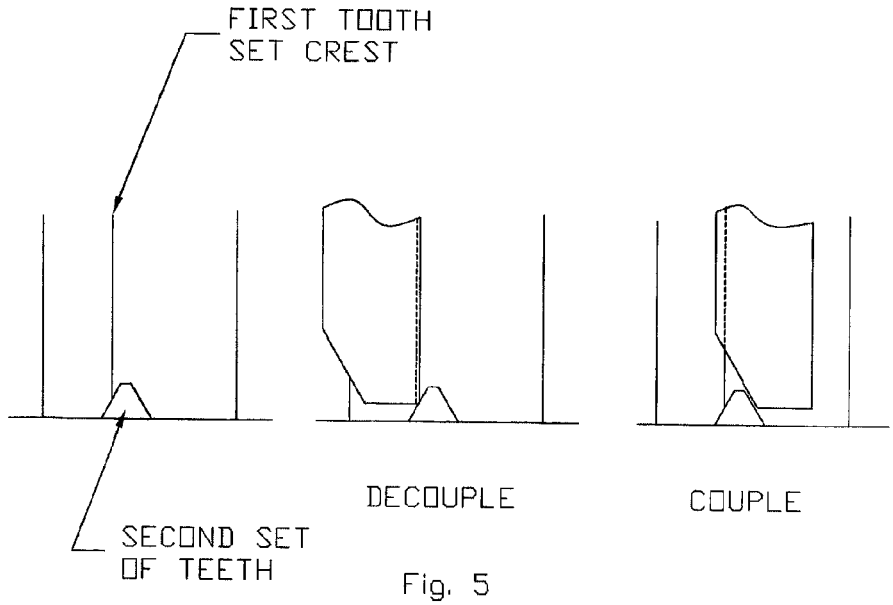
FIG. 5: A view of one possible arrangement of a second set of detent teeth.

This shoulder of the detent tooth ring can have additional detent teeth built in or attached to it such that the flexible detent tooth engaging members plus these teeth form a second "locked" condition in which the flexible detent tooth engaging members are required to flex circumferentially just as they are reaching or are at their maximum radially outward flex during the release from the first set of teeth where the torque level required to rotate the coupling nut is then dropping or has dropped to just that required to slide the flexible detent tooth engaging members across the crests of the first set of detent teeth This torque increase back to a high level acts to double the number of "locked" positions as the coupling nut rotates. See FIG. 5 for an example of such teeth (looking radially in toward the first set of teeth) that will bias the coupling nut in the tightening direction back towards a lock with the first set of teeth as the coupling nut tries to loosen (move in the decoupling direction) under vibration etc. because of the large asymmetry of the torque vs. tooth position with this arrangement of the set of teeth. The size and shape of the teeth of this second tooth set are such that the flexible detent tooth engaging members do not always engage them and must rise up to engage them by means of the radial flex caused by the first set of teeth and also can be such that the ring 4 must move to the left in FIG. 1 as described elsewhere in this description for this engagement to take place. In FIG. 5 the teeth of this second set of teeth and the ends of the flexible detent tooth engaging members are sized and shaped so as to make the associated decoupling torques substantially higher than the coupling torques. A view of the teeth sets without the flexible detent tooth engaging members in place is shown at the left in FIG. 5 for clarity and shows the second set of teeth located near the crest of the first set of teeth which such crest is otherwise only partially seen in the "couple" view and is hidden by the flexible detent tooth engaging member in the "decouple" view. This extra set of teeth works to increase the performance of the anti-decoupling mechanism in this manner with either a conical surface tooth arrangement for the first set of teeth or a cylindrical surface arrangement for the first set of teeth. This second set of teeth would also work to "lock" the mechanism if the first set of teeth were removed from the mechanism and just the conical or cylindrical surfaces plus the second set of teeth were present. This approach to the mechanism can have application in "quick" assembly where it is desired to be able to rotate the coupling nut easily on its mating threads until just before the final coupling is reached.

Further the independent or semi independent flexing nature of the flexible detent tooth engaging members and the space between them allows for a contamination tolerant system so a piece of material blocking flexible detent tooth engaging member engagement at one tooth has a low impact on the engagement of other flexible detent tooth engaging members with other teeth. The open space between the flexible detent tooth engaging members also allows them the potential to rake contaminants from the teeth.

Figure 6:
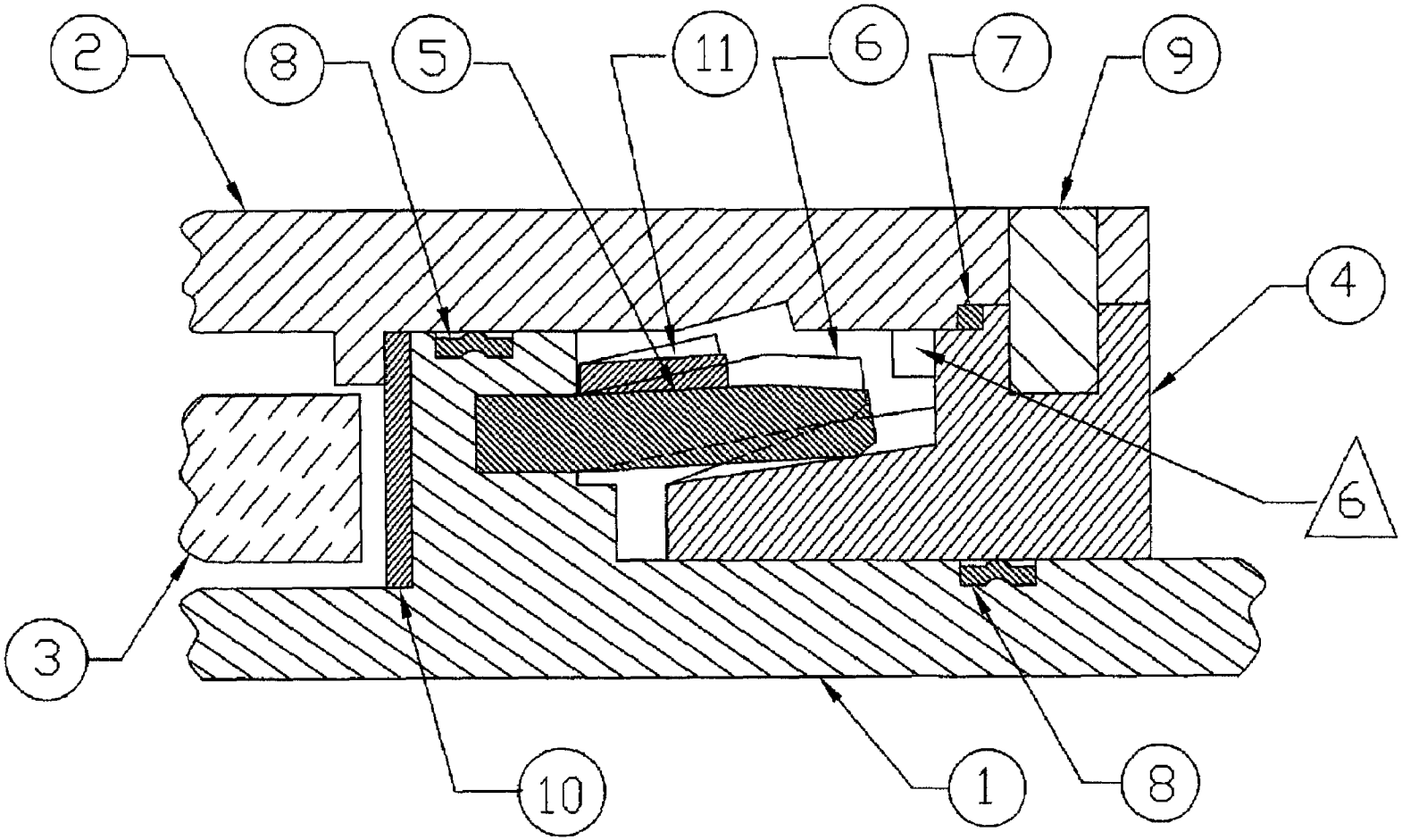
FIG. 6: The section of FIG. 1 modified to show a belt of spring fingers or other circumferential spring belt, Item 11, to engage and reinforce the flexible detent tooth engaging members if required and shows the general location envelope of a possible second set of detent teeth attached to the detent tooth ring 4. (Note Flag 6 of the Figure).
Figure 7:
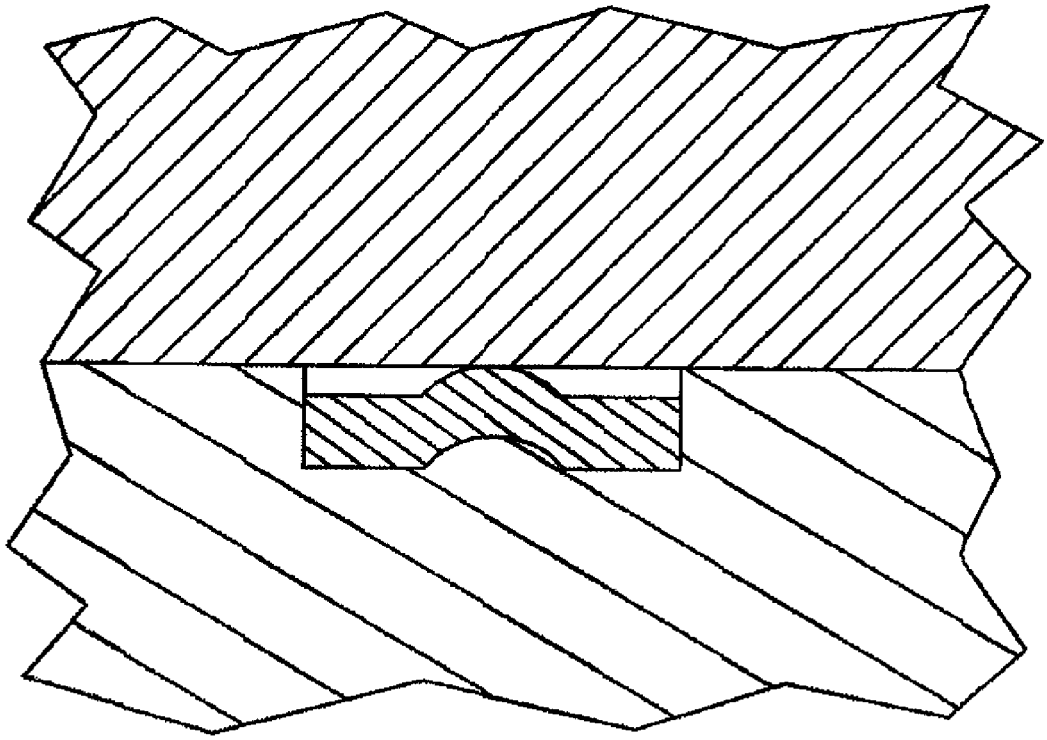
FIG. 7: A magnified view of the rotating/sliding seal—item 8 of FIG. 1.

If required the flexible detent tooth engaging members can be reinforced by a spring belt, belt of springs or circular fence of springs assembly, item 11 of FIG. 6, designed to engage the flexible detent tooth engaging members and reinforce them. This spring belt, belt of springs or circular fence of springs assembly is held in place by engaging features on the flexible detent tooth engaging members such as the space between the tabs shown in FIG. 4 Note Flag 5. This spring belt, belt of springs or circular fence of springs allows the flexible detent tooth engaging members to be made of wear resistant material that is not necessarily also good spring material.

Because of the compound slope (in this case they are located on an external conical surface) of the detent teeth the flexible detent tooth engaging members apply both radial and axial forces to the detent ring and thus to the coupling nut to which it is fixed. These forces are such as to try to restore the proper position of the coupling nut when it experiences environmental forces such as vibration.

A set of sliding/rotating joint tolerant seals at 8 (two places) and a fixed seal (if required by the method of assembly of the mechanism) at 7. As shown in FIG. 1 the rotating/sliding joint tolerant seals 8 are constructed by making a circumferential groove in the circumference of the tubular item—shell 1—wherein the groove has a central circumferential mound. Installed into this groove is a belt of heat shrink PTFE tubing or other suitable material that is shaped by the central mound as it shrinks or is placed into the groove so as to be in position so as to contact the inner diameter of item 2 (the coupling nut) and item 4 (the detent tooth ring) as they rotate about and slide back and forth along the axis of the shell 1 during the coupling and uncoupling processes. This provides an inherently high lubricity seal at these locations that is sliding/rotation, fluid, low and high temperature tolerant. The seal at 7 wherein item 2 and item 4 are fixed with respect to each other can be accomplished in the usual manner such as a ring consisting of metal or elastomer or other suitable material.

As the sealed mechanism functions there is a trapped air pressure altering change in volume within the mechanism as the coupling nut 2 moves axially with respect to the shell 1 between its stops as it does to some degree in all such mechanisms as the axial forces on its threads change during engagement and disengagement with the mating connector assembly. The air pressure in the mechanism also changes with changes in the temperature of the assembly. The seals described are designed to equalize these pressure changes over time with minimal distortion of the seals and thus reduce seal damage while maintaining a seal that minimizes the flow of solid or liquid contaminants past the seals.

As described above in all such mechanisms the coupling nut moves axially between stops as the axial forces on its threads change during engagement with the mating connector assembly most especially after the mating connector housing 3 contacts the shell 1 as is required by some connector specifications (or contacts item 10 if present—see the description of item 10 below). To control and take advantage of this natural motion, which motion must be stopped in all such coupling nut based ant-decoupling mechanisms, an extension is placed on the ring 4 such that the gap between it and a similar extension on the shell's externally extended flange (See Note Flag 2 in FIG. 1) closes during the coupling of the assembly preventing the coupling nut from moving too far to the left in FIG. 1 and damaging the mechanism. This motion of the coupling nut 2 causes the point of contact between the flexible detent tooth engaging members and the detent teeth on ring 4 to move up the off axis (conical) slope of the teeth and thus require the flexible detent tooth engaging members to flex more and thereby increasing the average normal force at their point of contact with the detent teeth. In this way the torque required to rotate the coupling nut increases at this point in the mating process. This torque increase would also take place if the first set of teeth were absent from the conical surface and the flexible detent tooth engaging members just slid across this surface as it moves towards them. This could fine use in "quick" couple versions of the mechanism. For the cylindrical surface arrangement for the first set of teeth this torque increase is provided only by the second set of teeth.

The coupling nut is prevented from moving too far in the other direction (to the right in FIG. 1) by the usual means of an internal radially extending flange on its internal diameter which bears on the radially extended flange of the shell 1. See Note Flag 1 of FIG. 1 and the following description of item 10 of that figure. The extension to ring 4 also has an additional ramp cut onto the detent teeth to properly pick up and place the flexible detent tooth engaging members on the detent teeth as the ring 4 is installed from the right and fixed to the coupling nut 2. This ramp can also prevent over flexing of the flexible detent tooth engaging members as they flex up and over the detent teeth.

Adjustment of the slopes of the various surfaces on ring 4 can make the required flex of the flexible detent tooth engaging members at their tip necessary to clear a tooth be larger than the height of the teeth which can be a tuning method for the mechanism. This extension to the ring also provides a large axial length of contact foot print between ring 4 and shell 1 to help stabilize the axial alignment of coupling nut 2 with shell 1 under vibration and other factors. This function is aided by the radial position restoring forces applied to ring 4 by the flexible detent tooth engaging members. The end of the extension on ring 4 where it contacts the axial extension on the external radially extended flange of shell 1 as this gap closes (See Note Flag 2 of FIG. 1) can be notched to make this closure tolerant of contamination since the contamination can be swept into the notches during operation of the mechanism.

An optional metal cushion 10 can be inserted between the contacting surfaces of the mating assembly 3 and the shell 1. This cushion is designed to accommodate irregularities in the contacting surfaces. These surfaces are generally constructed of hard materials. If present these irregularities can cause the advancing item 3 to come to rest on item 1 at just a few points within the intended area of contact. The assembly then proceeds to completion as the coupling nut is rotated to close the gap at Note Flag 2 of FIG. 1.

The maximum torque needed to reach the point where this gap is closed is, by design such as to meet a connector specification, not very high so as to ease assembly and is most likely small with respect to the torque that may be necessary to cause a sufficient flattening of the irregularities and thereby produce a large area of contact. During use of the assembly, vibration and other factors can progressively wear and thereby flatten the irregularities and result in a reduction in the integrity of the mated assembly even if the anti-decoupling assembly works perfectly since there is no provision for the assembly to self activate the coupling nut rotation to any large degree (except for a possible use of the second set of teeth described above) so as to reestablish a proper connector mating.

When the two connector assemblies are not mated this cushion 10 would be captured in place by the internal radially extended flange on the coupling nut 2. See Note Flag 1 in FIG. 1. The cushion 10 could be made of a softer metal than coupling nut 2, shell 1, and mating connector 3 or some other material suitable to its task. This cushion must be optional because some existing connector specifications may prevent its use. This cushion may not have the full radial extent as shown in FIG. 1 in order to clear features on the shell 1 during item 10's installation not shown in the figure but required by the requirements of a connector specification.

If the internally extended flange on the coupling nut is removed in some designs so that only the motion limiter stopping motion of the coupling nut towards the mating assembly remains then the simple nature of the mechanism allows sliding the coupling nut off the rear of the shell for inspection and service of the mechanism.

These embodiments have reached all the objectives of the invention.

Operation of an Example of the Preferred Embodiment of the Preferred Embodiment of the Anti-Decoupling Assembly As the coupling nut 2 is tightened onto the threads of the mating assembly 3 by rotating it in the usual way, the end of the mating assembly moves towards the external radially extended flange on the shell 1 again in the usual way (Item 3 in FIG. 1 moves to the right).

While this rotation takes place the flexible detent tooth members must flex to travel up and over the shallow long slope of the detent teeth on ring 4 requiring a higher but reasonable torque each time they do so. This provides the feel and sound of a well functioning anti-decoupling system to the operator.

When the mating assembly 3 finally contacts the external radial extended flange of shell 1 the coupling nut 2 and thus ring 4 start to move to the left in FIG. 1. As this takes place, it increases the degree to which the flexible detent tooth engaging members must radially flex (conical surface arrangement of the first set of teeth only) thereby increasing the normal force at the point of contact. This increases the torque necessary to rotate the coupling nut 2.

When the gap between ring 4 and the shell 1 at Note Flag 2 in FIG. 1 is eventually closed as much as the closest locked position of the flexible detent tooth engaging members in the detent teeth will allow, the anti-decoupling device is in its maximum assembly mated and anti-decoupling configuration. In order for the coupling nut to now rotate in the decoupling direction the flexible detent tooth engaging members must flex so as to move up the steep short slope of the detent teeth on ring 4 (the flexible detent tooth engaging member's tip can be differentially sloped for the second set of teeth if they are present). Therefore a higher torque is required to decouple the assembly than to couple it as is required for such an anti-decoupling device.

As the above axial motion of the coupling nut takes place the flexible detent tooth engagement members can come into a position where they engage the second set of detent teeth that can be built in or attached to the ring 4 and increase the anti-decoupling characteristics of the mechanism by utilizing a circumferential flexing of these members.

What is claimed is:

1. An anti decoupling mechanism for solid or tubular circular cross section assemblies having a rotating coupling nut or nuts which when used on circular electrical connectors the assembly comprises:

i) a tubular electrical connector shell having an external radially extending annular flange;

ii) a tubular coupling nut having a threaded portion and having an internal radially extended flange that is mounted on the shell and such nut can fully rotate about the shell and can slide along the shell between two axial stops that engage the coupling nut by a variety of normal means and secure it to the shell;

iii) the anti-decoupling mechanism which can provide some portion of the axial stops of (ii) in a usual way, but more particularly provides a differential in the torque necessary to rotate the coupling nut about the shell as its anti-decoupling feature;

iv) the threaded mating connector;

in this assembly the anti-decoupling mechanism consists of a simple and compact arrangement of the following few types of components:

a) a ring of a multiplicity of symmetrically or asymmetrically shaped, compound sloped detent teeth solidly fixed to the coupling nut—such teeth arranged on the external surface of a truncated cone with the small end of the truncated cone pointed towards the mating connector;

b) a circumferential arrangement of a multiplicity of independent or semi-independent flexible detent tooth engaging members—numbering from one up to one for each tooth—solidly fixed to the shell of the connector and pointed towards the small end of the above mentioned truncated cone such that a number of the detent teeth equal to the number of flexible detent tooth engaging members are simultaneously engaged by them or will be simultaneously engaged by them during operation of the mechanism with an individual force provided by the individual flexible detent tooth engaging member engaging each individual engaged tooth;

c) a set of two especially shaped rotation and sliding motion tolerant seals—one between the shell and coupling nut and the other between the ring of detent teeth and the shell that finish getting this special shape during installation into the circumferential groove in the shell in which they fit by means of contact with a central mound in the groove, these two seals acting in concert with a third ordinarily designed fixed seal (if required) between the ring of detent teeth and the coupling nut—all with high environmental resistance so as to seal and protect the interior of the anti-decoupling mechanism from solid or liquid contaminants while allowing for pressure equalization between the interior of the mechanism and the ambient barometric conditions with low consequential wear on the seals;

such that the design and arrangement of the above components produces:

1) a small mechanism—such as one example being just 0.300 inches in axial length from the outer surface of item 10 of FIG. 1 to the outer surface of item 4 of that figure;

2) an adequately sealed mechanism resistant to the transport of solid and liquid contaminants across the seals;

3) a mechanism with a small rotational angle between high torque "locked" positions of the coupling nut since a tooth pitch of 0.040 inches allows 47 locked positions on a 0.6 inch average diameter tooth ring;

4) a mechanism wherein the above simultaneous engagement of all the flexible detent tooth engaging members can allow them to be reduced in cross section as their number increases (an approximately 0.030 inches in diameter circular cross section flexible detent tooth engaging member can have a robust fit in 0.040 inch pitch teeth that are 0.015 inches tall) because the combined strength of the flexible members is great enough to perform the anti-decoupling function while having an individual force of the flexible members low enough to produce low forces at the individual tooth contact points so as to reduce wear on the mechanism and wherein;

5) the flexible detent tooth engaging members apply both axial and radial position restorative forces to the coupling nut because of their radial flex as the coupling nut moves under environmental forces such as vibration by means of the above mentioned conical sloping of the detent teeth with respect to the axis of the shell since this conical shaping splits the contact force into axial and radial components, and;

6) since all anti-decoupling mechanisms of this type must experience some axial motion of the coupling nut with respect to the shell which must be limited in at least the direction towards the mating connector, this mechanism, by means of the special shape and arrangement of parts given above along with the usual axial motion limiter or limiters, produces a beneficial, controlled, and limited increase in the torque required to turn the coupling nut as the mechanism approaches its final locked position after the two mating connectors have essentially come to a stationary axial position with respect to each other by means of mutual motion blocking contact by progressively increasing the degree of the required radial flex of the flexible detent tooth engaging members away from the shell because of the movement of the conically arranged detent teeth toward these flexible detent tooth engaging members and;

7) the mechanism stops this axial coupling nut motion when the detent tooth ring in moving towards the mating connector with the coupling nut to which it is solidly attached contacts the motion stop structure on the shell which contact eventually prevents further motion of the coupling nut in this direction and, 8) if the internal radial flange of the coupling nut is removed leaving only the motion limiter that stops coupling nut motion towards the mating connector, the coupling nut in some assembly designs because of the simple and secured nature of the mechanism's internal components can be removed from the rear of the connector shell for inspection and servicing of the anti-decoupling mechanism and other parts of the assembly.

2. The mechanism of claim 1 wherein the flexible detent tooth engaging members engage a second set of detent teeth on the detent ring so as to use circumferential flex of the flexible detent tooth engaging members about the circumference of the shell as an additional flex mechanism to the radial flex mechanism employed by the first set of teeth to form a complete second set of locked positions to bias the coupling nut back towards a lock with the first set of teeth after the coupling nut becomes unlocked from the first set of teeth to produce a built in retightening mechanism for the coupling nut and to allow the second set of teeth to have low wear potential because they are not engaged until near the end of the mating process.

3. The mechanism of claim 1 wherein the ring having the detent teeth has an extension portion fully within the sealed mechanism to engage the radially extending flange of the shell to prevent unwanted movement of the coupling nut towards the mating connector and that allows the extension portion to be notched so as to resist contamination and rake some of it into the notches.

4. The mechanism of any or all of claim 1, wherein the flexible detent tooth engaging members are sufficiently independent in flex and also sufficiently spaced apart to have the ability to rake some contamination out of the detent teeth so as to resist the negative influence of any particulate contamination that may enter or be generated within the anti-decoupling mechanism.

5. The mechanism of claim 1, wherein a mating cushion is added to the assembly to accommodate irregularities in the primary contacting surfaces of the two mated connectors so as to reduce the effect of wear of these irregularities on the integrity of the mating.

6. The mechanism of claim 1, wherein a stabilizing but rotating/sliding contact footprint between the coupling nut and the shell, by means of the shape of the intervening detent tooth ring is large so as to be beneficial to the function of the mechanism because of the special shape and axial extent of the base of the detent tooth ring where it contacts the shell, such shape being accommodated by the mechanism.

7. The mechanism of claim 1, wherein components creating some or all of the spring force necessary to engage the individual flexible detent tooth engaging members with the detent teeth are arranged so that they can be made of different materials by means of the addition of a circumferential belt of linked spring fingers or a circumferential spring belt or a circumferential fence of spring fingers attached to the shell any of which being linked to and engaging the flexible detent tooth engaging members so as to reinforce them and their spring force to allow an optimization of both the spring force and wear characteristics of the mechanism by permitting a wider choice of materials for both the flexible detent tooth engaging members and the detent teeth they engage.

8. The mechanism of claim 1, wherein the first set of teeth or any portion thereof are placed on the external surface of a cylinder which can have benefits in some applications such as altering the onset of torque increases.

9. The mechanism of claim 1, wherein the mechanism are adapted for placing the detent teeth on the inside surface of a cone or cylinder or placing the teeth on the shell and the flexible detent tooth engaging members on the coupling nut or flipping the axial relationship between components, wherein some of the components are eliminated such as the seals or the first set of teeth.

10. The mechanism of claim 1, wherein the mechanism is applied to circular mating assemblies that are solid or tubular and can have a rotating coupling nut or nuts (such as a jam nut on the mating assembly), but are either not coupled by using threads or are not electrical connectors or both.

* * * * *